United States Patent [19]

Bauer

[11] 4,171,808

[45] Oct. 23, 1979

[54] BASKETBALL METHOD

[76] Inventor: William Bauer, 212 Forester, El Campo, Tex. 77437

[21] Appl. No.: 937,916

[22] Filed: Aug. 30, 1978

Related U.S. Application Data

[62] Division of Ser. No. 626,255, Oct. 28, 1975, abandoned.

[51] Int. Cl.[2] ..... A63B 71/00

[52] U.S. Cl. ..... 273/1.5 R; 272/4

[58] Field of Search ..... 273/1.5 R, 1.5 A, 85 R, 273/95 R, 105 R; 272/3, 4

[56] References Cited

U.S. PATENT DOCUMENTS

| | | | |
|---|---|---|---|
| 1,064,914 | 6/1913 | Jones | 273/95 R |
| 3,388,909 | 6/1968 | Woods | 273/1.5 R |
| 3,544,109 | 12/1970 | Woods | 273/1.5 R |

FOREIGN PATENT DOCUMENTS

| | | | |
|---|---|---|---|
| 1957567 | 6/1971 | Fed. Rep. of Germany | 272/3 |

*Primary Examiner*—Paul E. Shapiro
*Attorney, Agent, or Firm*—Kenneth H. Johnson

[57] ABSTRACT

An improved basketball court and method for use by different forms or classes of players wherein a conventional basketball court has designated thereon a central court area used by one form and a peripheral court area designated for use by the second form wherein each of two teams have members of both forms on said teams such that the members of the two forms on one team play together in a cooperative manner, and the members of each form play on a team play against members of that form on the opposite team. The game played on the improved basketball court is substantially the same game as played on conventional basketball courts, with the advantage being for example, that male and female players can play in the same game on the same team without having to come into violent physical contact during the progress of the game.

4 Claims, 4 Drawing Figures fig.1
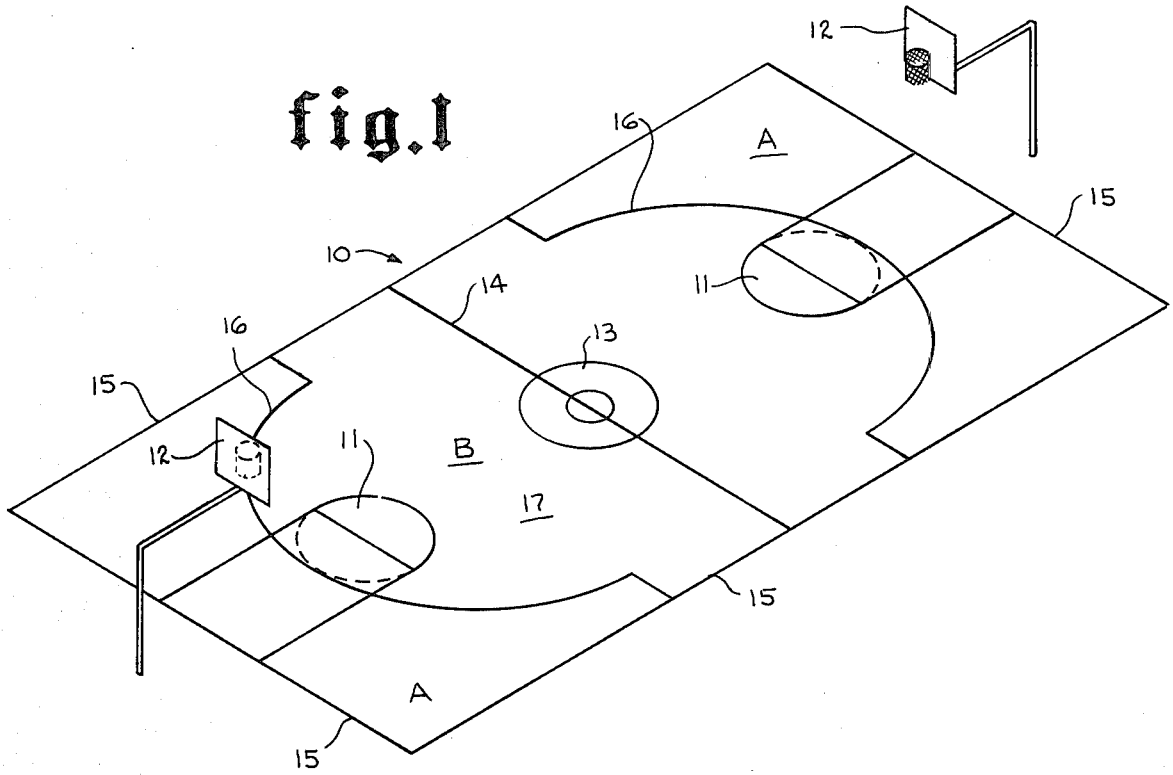
fig.2
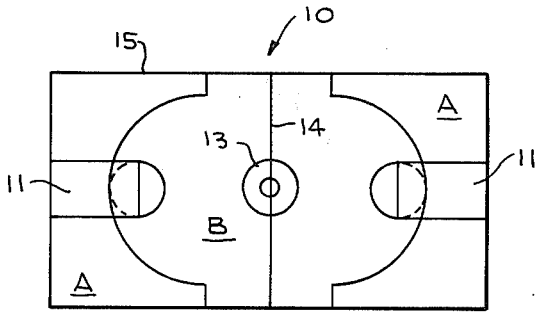
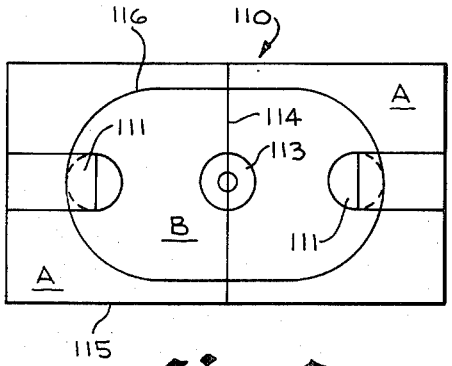
fig.3
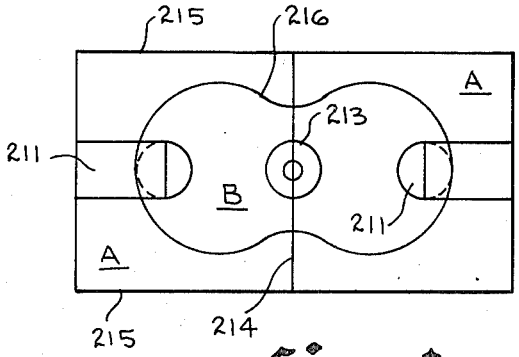
fig.4

BASKETBALL METHOD

This is a division of application Ser. No. 626,255, filed Oct. 28, 1975, now abandoned.

BACKGROUND OF THE INVENTION

The present invention relates to an improved apparatus on which to play a basketball game and the improved game played on the improved apparatus.

The present apparatus comprises a court and goals. The court may be the same size or substantially the same size court previously employed in basketball. Similarly the baskets or goals are substantially the same as employed in the prior game of basketball.

Currently there are many organizations and a great deal of pressure towards obtaining equal treatment between male and female. Some of the more vocal organizations have urged that the young male members of our society are allowed to compete in games such as basketball which develop the proper spirit of competitiveness which is ultimately necessary for these youngsters to succeed in business or the more competitive world and young females are denied their opportunity to compete in the same environment with the males and are thereby denied to come to understand their potential competitors in adult life. Since many of these sports are contact sports such as basketball, wherein it would be eminently unfair to put females against males on an equal physical level, young girls are deprived of the competitive experience, and thereby enter into adulthood at a disadvantage to their male peers. Hence, the female is held at a disadvantage even when job opportunities are made available to her.

The disparity between the physical development of males and females of peer groups is an accepted and established medical fact. In early childhood up through adolescence there is less of a physical difference, however even in these early years the male members of the peer group tend to have more muscular development than the female members. Similarly, after adolescence the male members of the group develop substantially more muscular physiques with or without particular effort in so doing, than the female members of the peer group, which would make any organized or direct physical competition directly between members of this older group completely unrealistic and eminently unfair to the female participants.

However, if there is any merit to the contention of those who hold to the belief the lack of competition by the female members of the peer group during this formative age in the competitive hard driving sports game, puts them at a disadvantage, and it would seem that this is logical since environment is an accepted factor in determining an individual's approach to life and lifestyle, it would appear that there must be some way to directly involve the females in the peer group directly in the highly competitive contact type sport in which the male members participate, without emphasizing the physical disparity between the two groups.

It is a feature of the present invention that a basketball game is playable on an adapted basketball court wherein different classes of participants may play on each team in accordance with substantially the same rules as prior art basketball is played, with the participants of different classes playing against another on opposite teams.

It is a further feature of the present invention that direct body contact between participants of different classes of skill or ability or physical characteristics is minimized or avoided entirely yet the element of competition and participation of the members of different classes is retained.

It is a particular advantage of the present invention that males and females may play on the same team, on the same court in the same game against a similarly constituted team.

It is further an advantage of the present game that younger and older participants may play on the same court in the same game and under the same rule against a similarly constituted team.

It is particularly a feature of the present invention that the one class of players may still play the game of basketball on substantially the same court and in substantially the same manner as before, and a second class of players will provide a supporting and additive role to the players of the first class or form.

A further feature of the present invention is members of different groups participate and enter into the competition with each other, while not making either group feel that it is inferior or being subjected to reverse discrimination by being forced into competition with the first group directly, thus the degree of competition which may be useful between males and females, can be achieved without the unnecessary antagonization of those who hold other views.

DRAWINGS

FIG. 1 is a perspective view of a basketball court apparatus according to the present invention having a central designated court area and a discontinuous second designated court area.

FIG. 2 is a top view of the court shown in FIG. 1.

FIG. 3 is an alternative court configuration.

FIG. 4 is an alternative court configuration.

SUMMARY OF THE INVENTION

The present invention, briefly is an improvement in a basketball court apparatus comprising a substantially rectangular court, a basket means located at opposed ends of said court along the long axis of said rectangle, for use in playing the sport, basketball, wherein the improvement comprises designating a first central portion of said court comprising over 50% of the area within said rectangular court and extending at least 70% of the distance along the long axis (and preferably the short axis also) of said rectangle and designating a second portion of said rectangular court comprising the portion of the court not included in said first central portion, said court being adapted for use by two teams, each of said teams comprising two or more members, each of said teams having two forms having one or more members in each form, whereby one form is assigned to each of said designated portions of said court, whereby the members of each team assigned to a form will be restricted, for the purposes of playing basketball, to said designated portion and will play against the members of the opposing in the same form. Preferably the central portion will occupy the geometric center of the rectangular court and will form a single continuous area. The second portion of the court will preferably be peripheral to the central portion and need not be continuous, but may be comprised of isolated areas at either end of the court.

The form assigned to second portion of the court will generally provide a supportive roll to the form assigned to the central area. For example if the center form were composed of males of 16 to 19 years of age, males of 10–15 could provide the supporting members of the second form, yet the central quality of the game would not deteriorate or slow down. Similarly the second form could be comprised of female members of the team. The apparatus and game of the present invention could just as well be played with the younger or female members in the first form with the older male players in the second form, supportive roll.

The principal advantage as noted above is that players of differing sex, age, physical ability or skill levels can play on the same team in the same game, at the same time, without playing directly against one another but against their sex, age or skill peers.

The term "form" as used herein means a group, class or designated members of a team which will play on one of the two designated areas of the improved basketball court described herein.

DETAILED DESCRIPTION OF THE INVENTION AND PREFERRED EMBODIMENTS

The basketball court apparatus of the present invention is not limited to courts of any particular size, although it is contemplated that the present basketball court as employed for example by NCAA or the various high school associations, will be employed for the overall dimensions of the court, with the designated areas being marked by appropriate means such as adhesive tape affixed within the existing courts so as to delineate the central designated court area from the second designated court area. It is also contemplated within the scope of this invention that the various forms of conventional basketball goals presently in use will be employed, without any necessary changes therein. Although certain shapes may be herein designated, as preferred, it is to be understood that the shape of the center court may be rectangular, elliptoid, regular or irregular. For example, the regular shape could be substantially elliptoid with a narrowed waist such as exhibited by probability curves, i.e., ($y=e^{-x2}$) giving the overall appearance to the court of a barbell appearance, however an elliptoid shape for the center court is preferred, in order to allow the principle play to be generated therein and to extend over substantially the entire length of the original, unmodified basketball court while allowing the members of the second form to have access to a fair portion of the court particularly at the goal ends and to be able to move from one goal end to the other end.

The present invention may be more readily understood in reference to the drawings. FIG. 1 is a perspective view of a standard basketball court approximately 45'9" by 84', delineated by 15, the out-of-bounds line which extends about the entire periphery of the court. The center line of the court 14 divides the court into two equal duplicate halves. The toss up circle 13 is that of a conventional basketball court. At each end there are duplicate free throw zones 11 situated immediately below and functionally related to the baskets, as is conventional in prior basketball courts. The central or center court area is designated B and it is delineated from the second court area A by the marker, i.e., a line 16 on the court 10. The line 16 may be affixed either by a means of adhesive tape, so that it can be removed for the use of the court in ordinary basketball, or it may be permanently affixed by painting as with the out-of-bounds lines 15. In FIG. 1, the second portion of the court A in discontinuous, hence in this type of arrangement the members of a team which belong to the A form would be permanently stationed at one end or the other of the court. The center portion of the court B is depicted as comprising well over 50% of the court area bounded by out-of-bound lines 15, and A court boundary lines 16 extending over 70% of the way along the longest axis of the rectangle of the court designated or delineated by the out-of-bounds line 15. This axis is designated by the dotted line 17.

In FIG. 2, the court illustrated in FIG. 1 is shown in the top view.

FIG. 3 represents one alternative embodiment of the present invention, providing for a continuous second court portion A separated from the center court portion B by continuous boundary line 116. Similarly in FIG. 4 another alternative embodiment is shown wherein the configuration is similar to that of FIG. 3, but the A portion of the court is increased by narrowing the central portion of the center court B as indicated by the continuous boundary line 216.

In each of the configurations shown in the figures the boundary line 116, and 216 become the new out-of-bounds lines for the members of the form which is designated to play in the B court area. The out-of-bounds markers for the members of the form designated to play in the A court area in each of the figures is designated by a combination of bounds lines 16–15, 115–116, and 216–215, respectively to the embodiments of FIGS. 1, 3 and 4.

The rules of the game played on the improved basketball court apparatus of the present invention are the same as the rules presently employed in basketball, there being variations depending on whether the games are played at junior high, high school, or college level, and within the various rule system. The only difference being the area of the court to which members of the A form and B form are restricted during the play. Furthermore, the number of players can vary but it is contemplated that between 3 and 6 members of the form designated to play one form will play on the designated B court area and between 3 and 6 members of a team will be designated to play on the A court areas.

The members of the form playing on the B court area may not cross over the boundary line into the A court area or over the out-of-bounds line 15 where it contacts the designated B court area. The penalties would be the same for crossing any of the out-of-bounds lines 15, 16, 116, or 216. Furthermore, since the members of the forms playing on the A and B courts respectively, cannot come into contact without the member from one form or the other forms being out-of bounds in regard to their designated court area, the penalties would be the same in regard thereto. For example, if a member of the form playing in the A court area were to step into B court area while having possession of the ball, the member would be out-of-bounds and that player's team would lose possession of the ball. If the member of the form A steps into the B court without the ball, then the penalty is the same as having an extra player on the basketball court improperly for that team. The same application of the rules would apply for a member of the form playing on the B court. Furthermore, it is the purpose of the division of the court to provide different forms, to avoid direct contact between the members of the two forms, and thus a player from one form who was contacted inadvertently by the member or player on the other form would be the same as a spectator who would be inadvertently contacted, however a member of one form who is purposely contacted by a member of the other form would be subject to appropiate disciplinary action currently provided by the rules of basketball. Whether the contact was intentional or unintentional would be a subjective judgement to be made by the referees on the court.

It is also contemplated that the present game will be played in the same time periods as presently employed in basketball games for the particular division involved. It is furthermore contemplated that the present games can also be played on the professional level if desired.

The invention claimed is:

1. In a method of playing basketball comprising two opposing teams having a plurality of players on a substantially rectangular court, having a basket means located at each opposed end of said court on the long axis of said rectangle, wherein the improvement comprises, having two or more members on each of said opposing teams, each of said teams having two forms, each of said forms having one or more members, assigning the members of one form of both teams to a first continuous central portion of said court, comprising over 50% of the area within said rectangular court and extending at least 70% of the distance along the long and short axis of said rectangular court, assigning the members of the other form of both teams to a second portion of said rectangular court comprising the portion of said rectangular court not included in said first central portion, said first and second portions being designated by lines on said court, the members of opposing teams of the form assigned to the first central portion playing the game of basketball against each other, and being restricted to said first central portion and in cooperation with the members of the same team of the other form, said members of the form, which is assigned to said second portion of the court being restricted to said second portion, whereby the members of one team belonging to different forms, play separately but cooperatively.

2. The method according to claim 1 wherein each team has the same number of members of each form.

3. The method according to claim 1 wherein said first central portion occupies the geometric center of said court.

4. The method according to claim 3 wherein the second portion is continuous.

* * * * *